United States Patent [19]

Kestner, Jr.

[11] 4,425,220

[45] Jan. 10, 1984

[54] METHOD OF AND APPARATUS FOR PROCESSING OF OIL SHALE

[75] Inventor: Daniel W. Kestner, Jr., Coraopolis, Pa.

[73] Assignee: Dravo Corporation, Pittsburgh, Pa.

[21] Appl. No.: 346,522

[22] Filed: Feb. 8, 1982

[51] Int. Cl.[3] ..... C10B 53/06

[52] U.S. Cl. ..... 208/11 R; 201/32

[58] Field of Search ..... 208/11 R; 201/28, 29, 201/32

[56] References Cited

U.S. PATENT DOCUMENTS

| | | | |
|---|---|---|---|
| 3,560,368 | 2/1971 | Rowland et al. | 208/11 R |
| 3,617,468 | 11/1971 | Reyburn et al. | 208/11 R |
| 3,644,193 | 2/1972 | Weggel et al. | 208/11 R |
| 3,668,077 | 6/1972 | Ban | 201/37 X |
| 4,126,180 | 11/1978 | Cha | 208/11 R |
| 4,193,862 | 3/1980 | Ban et al. | 208/11 R |
| 4,200,517 | 4/1980 | Chalmers et al. | 208/11 R |

*Primary Examiner*—Delbert E. Gantz
*Assistant Examiner*—Glenn A. Caldarola
*Attorney, Agent, or Firm*—Parmelee, Miller, Welsh & Kratz

[57] ABSTRACT

In the indirect method of retorting oil shale highly heated gases produced out of contact with flames in a heat exchanger are introduced into the retort and release oil vapor and high-value, high BTU gas and oil vapor from the shale which mix with the hot gas so introduced into the retort. Instead of burning the heat value gas of pipeline quality in the heat exchanger which is the present procedure, this invention fires the heat exchanger with abundant, cheap, low-value gas which for example is produced underground in-situ at or near the retort, thereby preserving the high value gas, after condensation of the oil vapor, partially for recirculation through the heat exchanger and retort and for in-plant operations, such a hydrogenation of the extract shale oil to produce refinable crude or for pipeline use.

4 Claims, 1 Drawing Figure

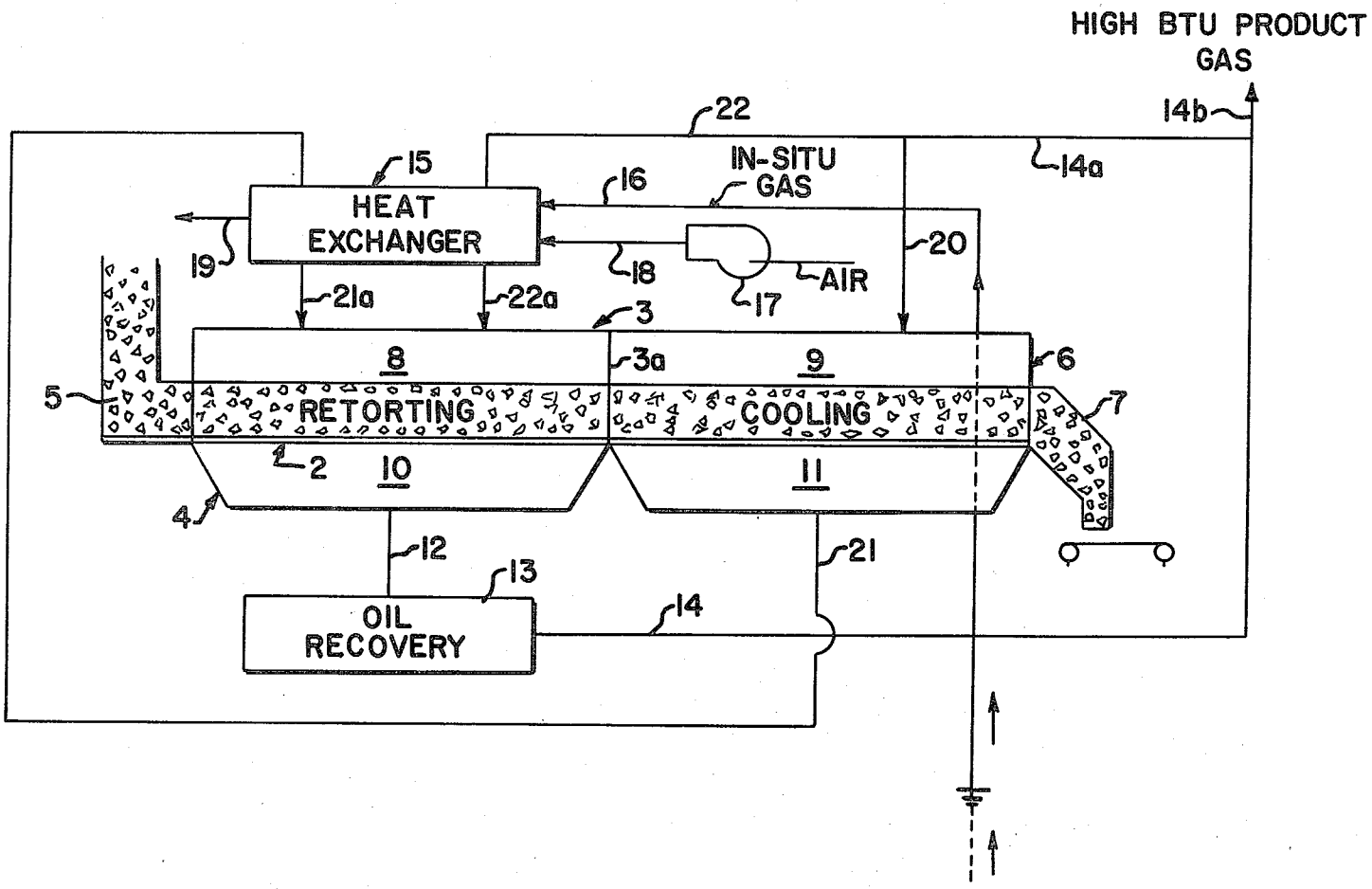
HIGH BTU PRODUCT GAS
14b
14a
22
IN-SITU GAS
16
15
HEAT EXCHANGER
19
21a
22a
20
AIR
17
18
3
3a
6
7
9
8
RETORTING
COOLING
11
10
2
4
5
21
12
13
OIL RECOVERY
14

METHOD OF AND APPARATUS FOR PROCESSING OF OIL SHALE

This invention is for an improvement in that method of and apparatus for the recovery of oil along with the production of high value gas in the retorting of oil shale known as the "indirect process".

BACKGROUND OF THE INVENTION

The recovery of oil from oil shale deposits is most commonly effected in above ground retorting operations, that is from oil shale brought to the surface and retorted in a nearby or on-site operation. Two procedures are now generally used, one the "direct method" and the other the "indirect method". These processes may be continuous or batch operations. The present invention is for the indirect method preferably using a continuous traveling grate retorting procedure but applicable also to other indirect processes.

In the direct process gas produced from the shale in the retort is mixed with air and recycled into the retort at a location along the traveling grate where volatiles have been largely removed in preceding stages of the distillation but where product gas derived from the distillation process is mixed with excess air and burned in the retort oxidizing the residual carbon in the shale. Heat so generated by combustion on the grate is used in the earlier stages of retorting and thus is recuperated resulting in the production of more product gas.

In the direct process, product gas in excess of what it burned is produced but it is combined with the products of combustion. It is what I term a "low value gas", too lean for pipeline gas or hydrogenation of the shale oil for use as crude refinery stock, and must be burned locally in plant operations, as for example, the generation of steam to operate a turbine driven electric generator.

In the indirect process, the major portion of the product gas is burned in a heat exchanger to heat recycle product gas. The hot non-oxidizing product gas, in turn, heats the shale on the grate to release the oil and generate the fresh product gas. In this closed cycle shale oil is recovered but the major portion of the product gas is consumed as fuel for the heat exchanger and exhausted from the heat exchanger as flue gas. The heat exchanger used for this purpose may be incorporated in the traveling grate itself or be separate from but close to the traveling grate. For simplicity of disclosure, the heat exchanger is shown in the accompanying drawings as an external unit adjacent the retort, but without exclusion of a heat exchanger comprising an integral section of the traveling grate retort.

BRIEF DESCRIPTION OF THE INVENTION

This invention comprises a modification of the indirect method wherein all or substantially all of the high value product gas from retorting the shale is made available for operations where a high value gas is required and the fuel for firing the heat exchanger is a low value, inexpensive and abundant gas from an external source. The gas so used is produced underground in the shale deposit and is known as "in-situ" gas. The product gas from the retorting of the oil shale is, in part, at least heated to a high temperature in a heat exchanger in which heat is generated from the burning of in-situ gas. The product gas so heated is then passed through the oil shale on the grate within the retort. The shale indirectly heated in this manner yields shale oil as condensate and a high-value product gas that mixes with the previously produced high value gas used as a heat transfer medium that carried heat from the heat exchanger to the retort so that the mixture of heat transfer gas and freshly produced high value gas is all of the same quality circulating in a substantially closed circuit and since no gas is burned in the closed circuit, there is available an off-stream comprising all the high value gas produced.

Instead of a low quality gas of from perhaps 40–60 BTU/SCF to as high as 100–150 BTU/SCF, the high value product gas produced incidentally to the recovery of the shale oil by my invention is in the range of 500–1000 BTU/SCF.

The invention may be more fully described by reference to the accompanying drawing in which there is schematically diagrammed portions of a traveling grate continuous retort process with an external heat exchanger as required for an explanation of my invention.

In the drawing which is entirely schematic, the traveling gate is designated generally as 2, and the enclosure is 3, divided into a retorting section 4 with an inlet 5 for charging oil shale which has been surface-prepared for retorting and a cooling section 6 with a spent shale outlet 7. In actual practice, the grate is usually circular with the retorting and cooling sections at nearly diametrically opposite sides of an enclosed circular area (here represented by line 3*a*) and with the charging station and discharge station closer than 180° of arc instead of being directly opposite as they appear in the diagram.

There is an enclosed space 8 in the enclosure above the retorting section of the grate and a similar space 9 above the cooling section. Likewise there is a space 10 in the enclosure under the grate in the retoring section and a space 11 below the grate in the cooling section. For simplification of disclosure in both the retorting sections and cooling sections, all flow of gases and vapors are represented as down-draft, or top-to-bottom flow, but in actual full size plant there may be reversals of all flow, or in the retort section there may be divisions in which some flow is down flow and other flow upflow, in order to secure favorable recuperation of heat, and the cooling section may be similarly divided. Downdraft in all areas is therefore to be taken as illustrative and not by way of any exclusive importance or limitation in this application.

From the retorting section 10 off-gases from the retorting operation are conducted through duct 12 to condenser 13 where the shale oil is collected and the high value gas is discharged into pipe 14.

There is schematically represented at 15 a heat exchanger adjacent the traveling grate. Fuel gas is supplied to a burner, not shown, that fires the heat exchanger. The fuel gas is supplied through pipe 16 and air for burning the gas is supplied from blower 17 and pipe 18. Fuel gases from the heat exchanger are discharged to a stack or otherwise disposed of as indicated by arrow 19.

High value product gas, stripped of the shale oil and discharged into pipe 14 is in part carried by branch pipe 14*a* and pipe 20 into the space 9 in the cooling section where it flows through the hot spent shale on the grate prior to the discharge of the shale from the outlet 7. In passing through the bed the product gas recuperates heat from the shale. This gas, so preheated, flows from space 11 through pipe 21 to be further heated by heat exchanger 15 (but not by any combustion of the product gas itself) and as thus highly heated, is discharged through duct 21*a* into the space 8 above the bed of shale on the grate, usually in that area of the grate where the most heat is required to release the less volatile residual hydrocarbons in the shale. These hot gases after passing through the grate and the shale carried by it enter space 10 and exit through pipe 12 to the oil condenser and collector, returning along with freshly generated gas to pipe 14.

Other product gas that enters branch pipe 14*a* is carried by and also discharged into the heat exchanger through duct 22 to become heated by the heat exchanger from which it flows into the retort through duct 22*a*. Since some of the product gas is recycled through the heat exchanger after first becoming preheated in cooling the spent shale, but none of it is used for combustion in the process, all of it is available for high value uses, being withdrawn from the system through outlet connection 14*b*.

The low value fuel gas supplied to the heat exchanger burner through line 16 can be economically produced underground by in-situ direct generation of the gas from destructive distillation of the oil shale in the geologic formation in which it occurs at an in-situ or nearby location by procedures well known in the art. Using below surface shale in-situ with little expense for fuel preparation of equipment or hauling as would be required for surface preparation and processing, by this invention I have discovered a method of gaining from the above ground retorting of shale oil, all of the high-value gas that is yielded from shale which is brought to the surface and distilled, and with a substantial saving in fuel cost over the previously available processes. I recognize that because of the low heat value of the in-situ gas than is available from a surface retorting operation, many more cubic feet of in-situ gas must be burned in this process than is required in using the high product gas for firing the heat exchanger, but since the combustion gases used to generate heat by the burning of leaner fuel never mix with the product gas, this greater volume of combustion gas is no detriment.

While I have shown and described the invention in connection with the preferred practice in the art, using a traveling grate retort, the invention may also be practiced in the operation of vertical shaft retorts and kiln type or rotary retorts, and with batch retorts, particularly batch retorts which are grouped together and operated out of phase to provide a substantially continuous production. All of the foregoing retort arrangements are comprehended by the term "enclosed environment" or "air-excluding, nonoxidizing environment."

Using an in-situ source or other source of lean gas as fuel, it may be desirable as a matter of precaution to provide the heat exchanger with a catalytic combustion technique to assure continuous combustion of the gas supplied to the burner in the heat exchanger.

Since there are available large deposits of oil shale, but the relatively high cost of producing it has made the recovery of oil commercially from shale unsatisfactory, the herein described process of conserving the high value gas for use in the conversion of shale oil for crude processing and high quality pipeline fuel, the process herein of low value inexpensive and readily available fuel gas for retorting the shale and recovering both oil and high value gas is believed to increase substantially to the profitable development of shale oil recovery. The term "in situ gas," as used herein and in the following claims, shall be construed in accordance with the definition attributed to this term on page 2, lines 24 and 25, hereof. The "value" of combustible gases is based on their Btu rating or caloric content.

I claim:

1. In the indirect process of retorting oil shale through contacting the shale in a non-oxidizing environment with non-oxidizing high value product gas heated to retorting temperature in a heat exchanger and discharged at retorting temperature into said closed environment to release from the shale, oil vapors and high value product gas into said closed environment to mix with and add to the volume of the heated gas so introduced into the closed environment, conducting the mixture of gas and vapors from the closed environment and condensing therefrom the oil vapor and conducting the gas after removal of the oil into a duct system from which a portion only of the high value product gas is recycled to the heat exchanger to be heated and discharged into said closed environment at retorting temperature, the invention comprising:

(a) the withdrawal from said duct system of a portion of high value gas that is not required for recycle to the heat exchanger in the retorting of the shale and for use as high caloric value gas entirely outside the retorting and recycling system;

(b) circulating a second portion of the recycled high value gas from the duct system through the shale from which oil has been removed in a non-oxidizing atmosphere to recover heat from the shale and to preheat said second portion of the high value gas prior to passing it through said heat exchanger; and (c) firing the heat exchanger with abundantly available low value, low cost gas produced entirely independently of the oil extraction system as a fuel for the heat exchanger, the gases from the burning of which in the heat exchanger are discharged from the heat exchanger as stack gases.

2. The process defined in claim 1 wherein the low value low cost fuel comprises in-situ gas.

3. The process defined in claim 2 in which the in-situ gas is produced at or immediately adjacent the location where the process is practiced.

4. The process defined in claim 1 in which enclosed environment comprises a continuous traveling grate and a portion of the heat is supplied to the recycle gas given to the heat exchange is preheated by recuperation of heat by the cooling of spent shale after it has been subjected to the retorting process to thereby make more high value gas available for removal from the system for use elsewhere.

* * * * *